US005685050A

United States Patent [19]

Murasaki

[11] Patent Number: 5,685,050

[45] **Date of Patent: *Nov. 11, 1997**

[54] HOOK STRUCTURE FOR MOLDED SURFACE FASTENER

[75] Inventor: Ryuichi Murasaki, Toyama-ken, Japan

[73] Assignee: YKK Corporation, Tokyo, Japan

[ * ] Notice: The term of this patent shall not extend beyond the expiration date of Pat. No. 5,625,930.

[21] Appl. No.: 499,652

[22] Filed: Jul. 7, 1995

[30] Foreign Application Priority Data

Jul. 8, 1994 [JP] Japan ..... 6-157351

[51] Int. Cl.[6] ..... A44B 18/00

[52] U.S. Cl. ..... 24/449; 24/442; 24/452

[58] Field of Search ..... 24/442, 306, 446, 24/450, 452, 449

[56] References Cited

U.S. PATENT DOCUMENTS

| | | | |
|---|---|---|---|
| 4,933,224 | 6/1990 | Hatch | 24/306 X |
| 4,984,339 | 1/1991 | Provost et al. | 24/442 X |
| 5,131,119 | 7/1992 | Murasaki et al. | 24/442 X |
| 5,179,767 | 1/1993 | Allan | 24/442 |
| 5,212,853 | 5/1993 | Kaneko | 24/442 X |
| 5,339,499 | 8/1994 | Kennedy et al. | 24/442 X |
| 5,361,462 | 11/1994 | Murasaki | 24/442 X |
| 5,392,498 | 2/1995 | Goulait et al. | 24/446 X |

FOREIGN PATENT DOCUMENTS

| | | |
|---|---|---|
| 0 464 753 | 1/1992 | European Pat. Off. . |
| WO 94/18864 | 9/1994 | WIPO . |

*Primary Examiner*—Peter M. Cuomo
*Assistant Examiner*—Stephen Vu
*Attorney, Agent, or Firm*—Hill, Steadman & Simpson

[57] ABSTRACT

In a molded surface fastener composed of male and female members, each of hook-shape engaging elements of the male member comprises a stem standing substantially perpendicularly from a flat plate-like base, a hook-shape head extending forwardly from a part of the upper end portion of the stem, and a branch extending from another part of the upper end portion of the stem over the hook-shape head by a predetermined length and terminating in a backwardly bent end.

13 Claims, 6 Drawing Sheets

HOOK STRUCTURE FOR MOLDED SURFACE FASTENER

BACKGROUND OF THE INVENTION

1. Field of the Invention

This invention relates to a surface fastener member obtained by integrally extrusion molding or injection molding a flat plate-like base and a multiplicity of hook elements using thermoplastic synthetic resin, and more particularly to a hook structure, for a surface fastener, which secures a predetermined degree of peel strength with a companion surface fastener member obtained by molding.

2. Description of the Related Art

Conventional surface fasteners of the type described above generally comprise male and female fastening members composed of a multiplicity of male and female engaging elements, such as hook and loop elements, standing on confronting surfaces of mating flat plate-like base. Various other shapes such as an anchor shape and a mushroom shape have been proposed for the male engaging elements and are currently used. However, with the mere anchor or mushroom shape, the male engaging elements tend to hang on the loop elements of the companion fastening member when the mating fastener members are joined, thereby causing an excessive degree of peel strength so that the male and female engaging elements would tend to damage one another. As a result, once the mating fastener members have been peeled off, the engaging strength would be lowered considerably to become not worth using practically.

In the male engaging elements of the most popular surface fastener, a monofilament is woven or knitted in a woven base so as to have piles, and part of the respective pile is then cut to form hook elements. This type surface fastener has a very smooth touch in engaging and peeling with respect to the loop elements of the mating member due to the softness of the woven base and the softness of the monofilament. Since the monofilament forming the hook elements is prepared via a drawing process, it is excellent in pulling and bending strength for its small cross-sectional area. Further, since the woven structure has the hook elements in very high density, it is possible to achieve a high rate of engagement and an adequate durability for repeated use. However, since this woven type surface fastener is large in consumption of material and requires many processing steps, it is hard to reduce the cost of production, and the degree of engaging strength is insufficient to apply to various kinds of industrial materials and interior materials.

As a solution, a molded engaging member for surface fasteners is disclosed in, for example, U.S. Pat. No. 4,984,339 and European Pat. No. 0464753, in which a base and hook elements are molded integrally and simultaneously by extrusion. In production, molten thermoplastic resin is extruded onto the peripheral surface of a rotating drum formed of a laminate of mold disks and spacer plates alternately overlaying one over another, so that the resin is forced into hook-forming cavities of the mold disks. As hook elements are integrally molded with the base, the hook elements in the cavities are removed, together with the base, from the drum surface in timed relation with the rotation of the drum. The engaging elements to be integrally molded with a base for the surface fastener member have a hook shape which waves on the whole in longitudinal cross section as shown in FIG. 10(A) of the accompanying drawings. And the hook element 11' has on each of opposite side surfaces of its base a reinforcing rib 15 which prevents the hook element 11' from falling flat sideways, securing a constant engaging rate between the hook elements and the loop elements of the companion member for a long period of time.

However, since the surface fastener member of the type in which the base and the engaging elements are integrally molded has a technological limit in manufacturing the mold, it is inevitable to increase the size of the individual engaging elements so that the hook elements per unit area are reduced in number to lower the rate of engagement with the engaging elements of the companion member. In order to increase the engaging strength to cover the lowness of the engaging rate, each hook-shape head of the engaging element has a predetermined degree of rigidness.

In the meantime, if the thus molded surface fastener is used for various kinds of industrial or interior materials, the mating members are required to be peeled off from each other but not to be peeled off too easily, without giving any damage to the male and female engaging elements, when a predetermined amount of peeling force is exerted on the surface fastener. For example, when attaching a car interior panel to a car body, the mating members have to engage each other reliably and to retain adequate engaging strength. And when the interior panel is to be removed from the car body for car inspection or other purposes, the mating members have to be peeled off without giving any damage to the male and female engaging elements.

FIGS. 10(A) through 10(D) show the manner in which the male member 1' and the female element 2' act during the engaging and peeling of the conventional molded surface fasteners. FIG. 10(A) shows the hook element 11' and the loop element 21' before the fastening members are joined together. When the female member 2' is forced against the male member 1' in an effort to bring the hook element 11' into engagement with the loop element 21', firstly the engaging surface of the female member 2' is pressed against the engaging surface of the male member 1'. At that time, the hook element 11' of the male member 1' is pressed by the engaging surface of the female member 2' to bend forwardly in such a manner that the open portion of the hook element 11' deforms in the closing direction, as indicated by an arrow in FIG. 10(B). To this end, it becomes difficult for the distal end of the hook element 11' to engage with the loop of the loop element 21'. FIG. 10(C) shows the hook element 11' and the loop element 21' after the fastening members have been joined together. If the male and female members 1', 2' are moved in the peeling directions for separating the joined fastening members of FIG. 10(C), the loop element 21' in engagement with the hook element 11' acts so as to bend the hook element 11' backwardly in such a manner that the distal end of the hook deforms to be raised so that the loop element 21' is removed from the hook element 11'. As a result, the male and female members 1', 2' are peeled off. Accordingly, this peel strength depends on the rigidity of the hook element 11', and the greater the softness of the molding material is, the lower the peel strength would be.

In this conventional type molded surface fasteners, if the degree of rigidness of molding material is increased, the male and female members would tend to be damaged when peeled off, and if the softness of the molding material is greater, the male and female members would tend to be peeled off too easily. This conventional surface fasteners are therefore not suitable for industrial and interior materials.

SUMMARY OF THE INVENTION

With the foregoing problems in view, it is an object of this invention to provide a hook element structure, for molded surface fasteners, which can secure an adequately high rate of engagement with the companion engaging elements, can achieve adequate peel strength, with some degree of softness, and is durable for repeated use.

According to a first aspect of this invention, the above object is accomplished by a molded surface fastener member comprising a flat plate-like base molded of synthetic resin, and a multiplicity of hook elements molded on one surface of the flat plate-like base, each of the hook elements having a stem standing substantially perpendicularly from the flat plate-like base, a hook-shape head extending forwardly from one part of a free end portion of the stem, and a branch extending over the hook-shape head by a predetermined length from another part of the free end portion of the stem and terminating in a backwardly slightly bent portion.

Preferably, the stem has on at least one of opposite side base portions thereof a reinforcing rib, and the hook-shape head and the branch are formed by bisecting the stem forwardly and backwardly, or the hook-shape head and the branch are formed by bisecting the end portion of the stem laterally. Alternatively, the hook-shape head may be a double structure having a pair of identical hook-shape heads situated respectively on each of the opposite sides of the branch, and such two hook-shape heads and the branch may be formed by dividing the end portion of the stem laterally. The bent portion of the branch may be in the shape of a backwardly extending hook.

In the molded surface fastener according to a second aspect of the invention, the hook heads of adjacent two of the hook elements may be oriented in opposite directions or in perpendicularly inter-crossing directions.

In use, when the engaging surface of the female member is pressed against the engaging surface of the male member, the engaging surface of the female member is pushed against the bent end portions of the branches. Thereby the bent end portions of the individual branches begin to flex downwardly and, at the same time, the individual branch and the associated stem flex about the foot of the stem so as to angularly move the entire hook element in the pushing direction. As a result, the end portion of the individual hook element deforms in the same direction to open the opening of the hook widely to receive the loop engaging element. The bent end portions of the branches slide on and along the engaging surface of the female member so that some loop engaging elements enter the openings of the hook elements to be caught, and at the same time, the bent end portions of the branches are threaded through the other loop engaging elements.

Thus the male and female members of the surface fastener have been joined together. At that time, the loop engaging elements caught by the hooks of the hook-shape engaging elements extend more than the other loop engaging elements.

To peel the female member off the male member, the female member is pulled up in the direction of peeling off the male member so that the loop engaging elements caught by the hooks are raised strongly to flex the distal ends of the hooks in the standing direction and, at the same time, the other loop engaging elements threaded on the distal ends of the branches raise the bent end portions of the branches. As a result, the loop engaging elements located in front of and behind the male engaging element come into engagement with the male engaging element to pull up the hooks and the bent end portions simultaneously, and the branch suppresses the flexing of the hooks with the stems kept in an upright posture, thereby increasing the engaging strength to prevent the loop elements from accidental removal from the hooks.

DETAILED DESCRIPTION OF THE PREFERRED EMBODIMENTS

Figure 1:
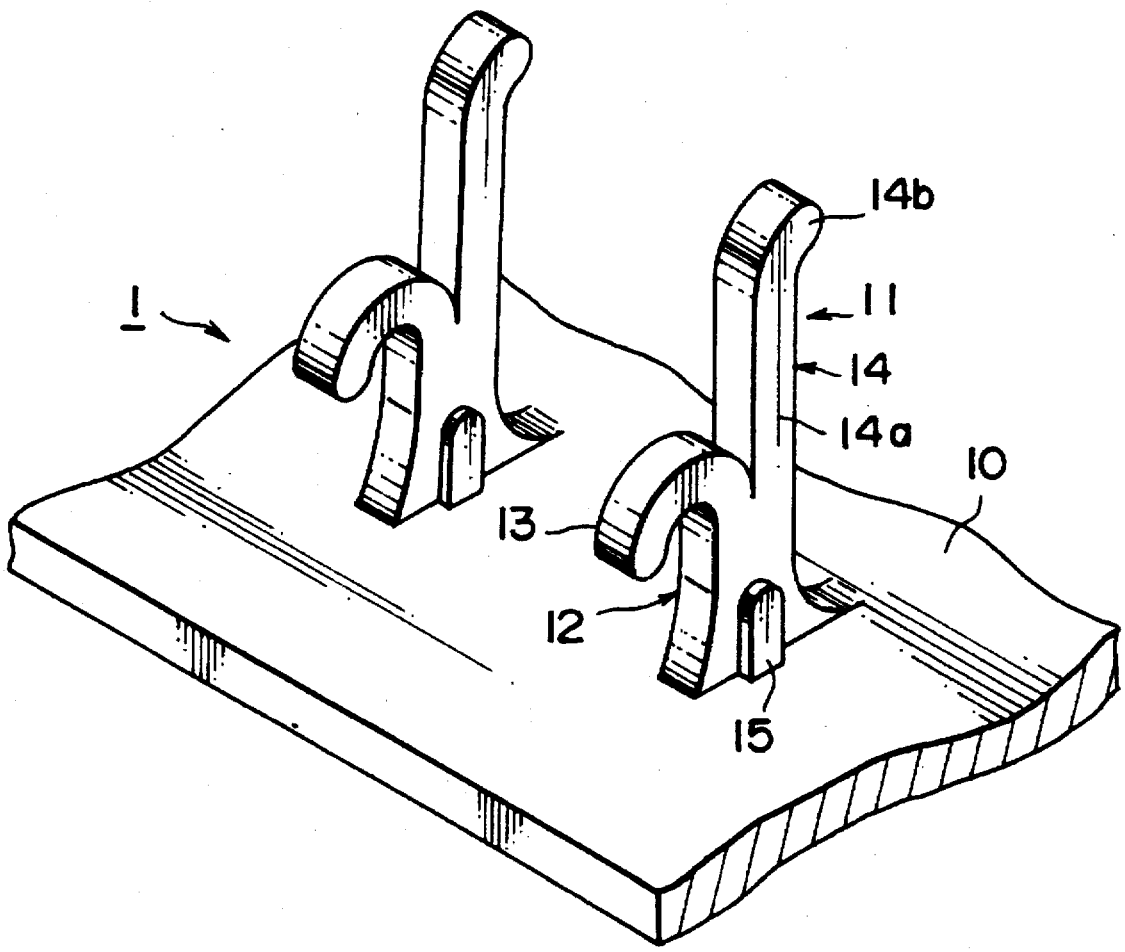
FIG. 1 is a fragmentary perspective view of a male member of a molded type surface fastener, showing a hook-shape engaging element structure according to typical embodiment of this invention.

Preferred embodiments of this invention will now be described in detail with reference to the accompanying drawings. FIG. 1 is a fragmentary perspective view of a male member of a molded surface fastener, showing a typical hook-shape engaging element structure of this invention. In FIG. 1, reference numeral 10 designates a flat plate-like base on which a multiplicity of hook-shape engaging elements 11 having a unique structure according to this invention are arranged in rows and columns and are oriented in a common direction in each row to constitute an engaging surface of a male member 1. The base 10 and the hook-shape engaging elements 11 are simultaneously and integrally molded of thermoplastic synthetic resin by extrusion or injection molding.

Each hook-shape engaging element 11 of this embodiment comprises a stem 12 standing substantially perpendicularly from one surface of the flat plate-like base 10, a hook-shape head 13 extending forwardly from a part of an upper end of the stem 12, and a branch 14 extending from another part of the upper end of the stem 12 over the hook-shape head 13 by a predetermined length and terminating in a slightly backwardly bent end.

The stem 12 has a varying width increasing progressively toward the base 10 as viewed in side elevation and has a reinforcing rib 15 molded on each of opposite side surfaces of the foot of the stem 12 and standing perpendicularly from the base 10. In the illustrated embodiment, on the upper end of the stem 12, there are provided the hook-shape head 13 and the branch 14, which constitute a characteristic feature of this invention. Specifically, the hook-shape head 13 and the branch 14 are formed by bisecting the upper end portion of the stem 12. The hook-shape head 13 is a downwardly directed hook, and the branch 14 extends upwardly along the back surface of the hook-shape head 13 substantially perpendicularly of the base 10 and terminates in a slightly backwardly bent end 14b of a branch body 14a, the bent end 14b being bent remotely from the hook-shape head 13.

Figure 2A:
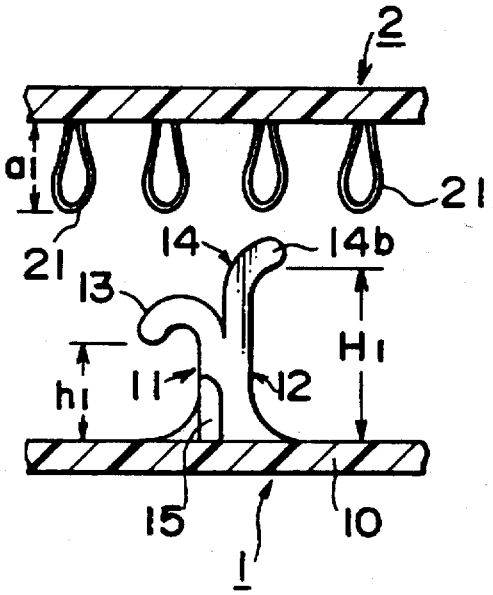
FIGS. 2(A) through 2(D) show the manner in which the hook-shape engaging elements come into and out of engagement with loop engaging elements of a companion female member.

FIGS. 2(A) through 2(D) show the manner in which the male member 1 having the hook-shape engaging elements 11 comes into and out of engagement with the female member 2 having the loop engaging elements 21. FIG. 2(A) shows the hook-shape engaging element 11 before an external force is not yet exerted on the surface fastener, the engaging element 11 assuming a posture identical with that when molded. As is apparent from FIG. 2(A), the distance H1 between the distal end surface of the bent end portion 14b of the branch 14 and the surface of the base 10 is larger than the distance h1 between the distal end surface of the hook-shape head 13 and the surface of the base 10.

Figure 2B:
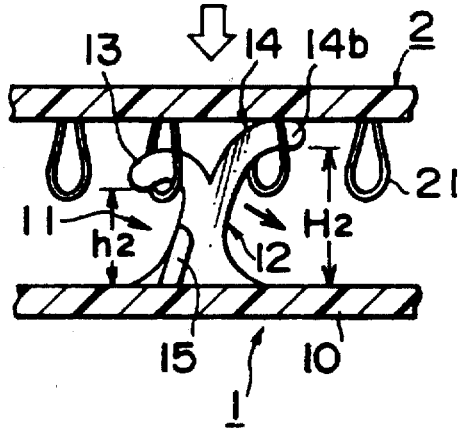

FIG. 2(B) shows the hook-shape engaging element 11 when the engaging surface of the female member 2 is pressed against the engaging surface of the male member 1. As the engaging surface of the female member 2 is forced against the engaging surface of the male member 1, firstly the engaging surface of the female member 2 is pushed against the upper end of the branch 14 of the hook-shape engaging element 11. The bent end portion 14b of the branch 14 then begins to flex downwardly and, at the same time, the branch body 14a and the stem 12 flex so as to angularly move the entire engaging element 11 about the foot of the stem 12 in the pushing direction. In response to this, the distal end of the hook-shape head 13 also deforms in the same direction to open the opening of the hook widely to receive the loop engaging element 21, and the bent end portion 14b of the branch 14 slides on and along the engaging surface of the female member 2 so that some loop engaging elements 21 enter the openings of the hook-shape heads 13 and are caught by the hooks and, at the same time, the bent end portions 14b of the branches 14 are threaded through the other loop engaging elements 21. At that time, the distance H2 between the distal end surface of the bent end portion 14b of the branch 14 and the surface of the base 10, and the distance h2 between the distal end surface of the hook-shape head 13 and the surface of the base 10 have the following relationships with the corresponding distances H1 and h1 of FIG. 2(A): H1>H2 and h1<h2 where H2>h2.

Figure 2C:
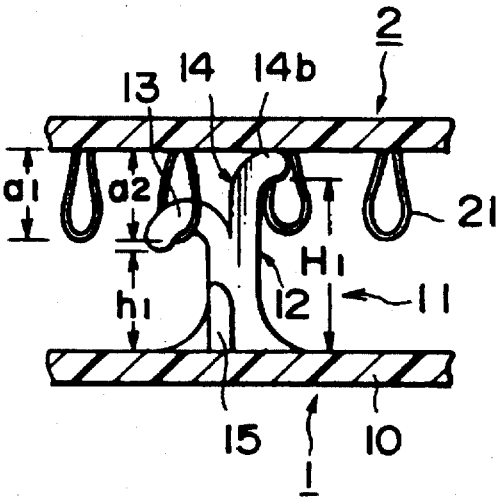

FIG. 2(C) shows the male and female members 1, 2 when they are joined together. At that time, the hook-shape engaging elements 11 of the male member 1 assume a posture substantially identical with that of FIG. 2(A). Since the loop engaging elements 21 in engagement with the hook-shape heads 13 of the hook-shape engaging elements 11 are extended beyond the other loop engaging elements 21, they have a loop length a2 slightly greater than the length a1 of the loop engaging elements 21 out of engagement with the hook-shape heads 13.

Figure 2D:
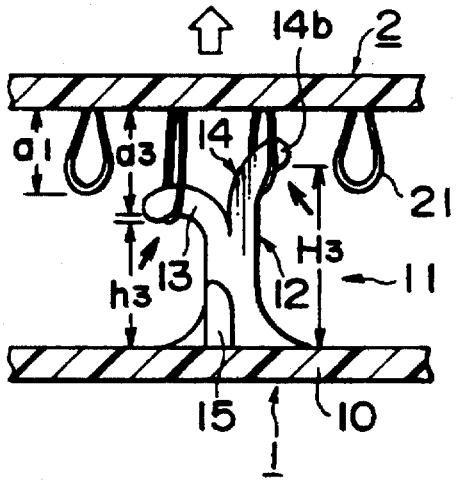

FIG. 2(D) shows how the hook-shape engaging elements 11 and the loop engaging elements 21 deform when the female member 2 is peeled off the male member 1. When the female member 2 is raised from the male member 1 in the peeling direction as indicated by an arrow in FIG. 2(D), the loop engaging elements 21 in engagement with the hook-shape heads 13 are pulled up strongly to flex the distal end of the hook-shape head 13 in the standup direction slightly and, at the same time, the loop engagement elements 21 through which the distal ends of the branches 14 are threaded would pull the bent end portions 14b of the branches 14 upwardly to come into engagement therewith. As a result, the loop engaging elements 21 existing in front of and behind the hook-shape engaging elements 11 come into engagement therewith to pull the hook-shape heads 13 and the bent end portions 14b simultaneously upwardly as indicated by an arrow in FIG. 2(D), and the branches 14 suppress the flexing of the hook-shape heads 13 with the stems 12 kept in an upright posture, thus increasing the engaging strength so that the loop engaging elements 21 would not tend to remove from the hook-shape heads 13 too easily.

At that time, the distance H3 between the distal end surface of the bent end portion 14b of the branch 14 and the surface of the base 10, the distance h3 between the distal end surface of the hook-shape head 13 and the surface of the base 10, and the length a3 of the loop engaging elements 21 in engagement with the hook-shape heads 13 of the hook-shape engaging elements 11 have the following relationships with H1, H2, h1, h2, a1, a2: H2<H3<H1, h1<h3<h2, a1<a2<a3.

FIGS. 3 through 6 shows various modifications of the hook-shape engaging element of this invention. Like reference numerals designate similar parts or elements throughout these views.

Figure 3:
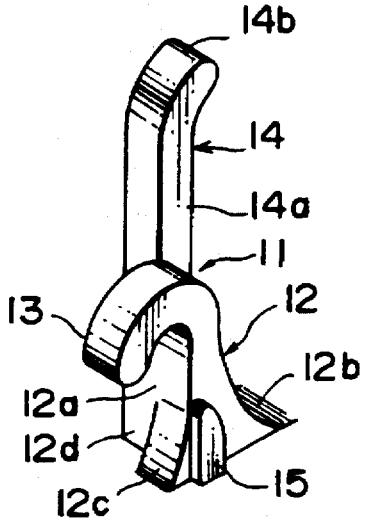
FIG. 3 is a perspective view showing another hook-shape engaging element structure.

In the modification of FIG. 3, the hook-shape head 13 and the branch 14 are formed by bisecting the upper end portion of the stem 12 laterally; the hook-shape head 13 is a downwardly directed hook, while the branch 14 extends upwardly along one side surface of the hook-shape head 13 substantially perpendicularly of the base 10 and terminates in a slightly backwardly bent end portion 14b, which is bent in the direction remote from the hook-shape head 13. Accordingly, the stem 12 has a composite width of the hook-shape head 13 and the branch 14, and the hook-shape head 13 has a rear surface 12b remote from the hook and standing in a smooth curve from the surface of the base 10. The lower front surface 12c of the hook-shape head 13 is inclined in a smooth curve from a substantially upright stem portion 12a toward the surface of the base 10, while the lower front surface 12d of the branch 14 extends downwardly from the branch body 14a perpendicularly to the surface of the base 10. On each of opposite side surfaces of the stem 12 at a position toward the hook-shape head 13, there is formed a reinforcing rib 15 like the previous embodiment.

With this structure, though it is substantially identical in function with the previous embodiment, the stem 12 is laterally wide so that the hook-shape engaging element 11 is suppressed from falling sideways and hence the reinforcing rib 15 may be omitted.

Figure 4:
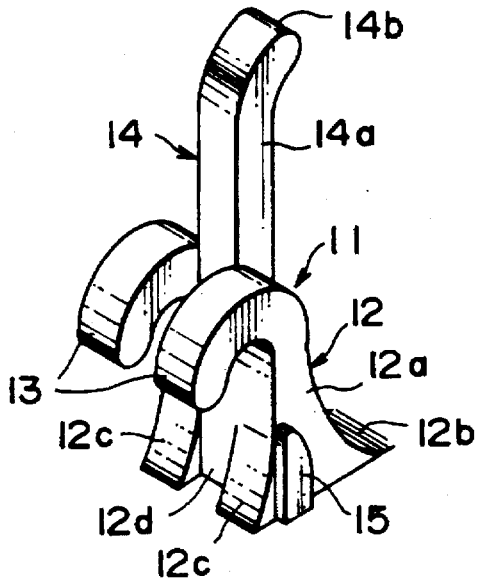
FIG. 4 is a perspective view showing a further another hook-shape engaging element structure.

In the modification of FIG. 4, unlike the modification of FIG. 3 in which the hook-shape head 13 and the branch 14 are formed by bisecting the upper end portion of the stem 12 laterally, the hook-shape head 13 is a double structure having a pair of identical hook-shape heads situated respectively on each side of the branch 14, and such two hook-shape heads 13 and the branch 14 are formed by dividing the upper end portion of the stem 12 laterally. With this arrangement, the hook-shape engaging elements 11 are prevented, more effectively compared to the previous modification, from falling sideways, and a single branch 14 supports the two hook-shape heads 13 so that the two hook-shape heads 13 can engage the loop engaging elements 21 effectively and reliably as the rate of engagement, i.e. the number of hook-shape engaging elements 11 per unit area on the base 10 (density of hook-shape heads 13) becomes greater.

Figure 5:
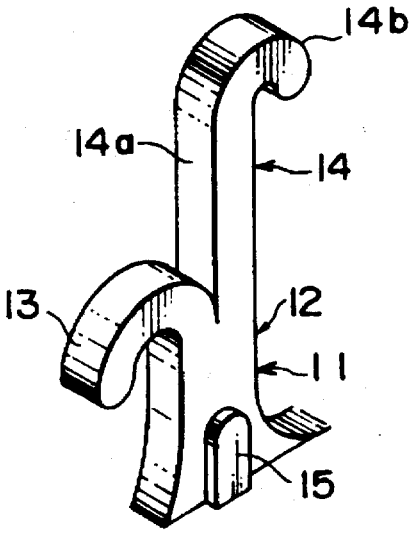
FIG. 5 is a perspective view showing a modification of the hook-shape engaging element structure of FIG. 1.
Figure 6:
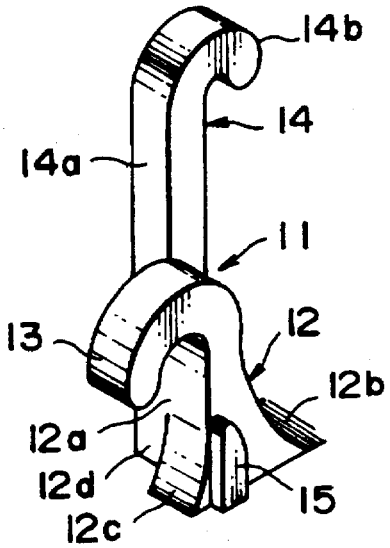
FIG. 6 is a perspective view showing a modification of the hook-shape engaging element structure of FIG. 3.

FIGS. 5 and 6 show further modifications of the hook-shape engaging element structures of FIGS. 1 and 3, respectively. In these modifications, the bent end portions 14b of the branches 14 has such a hook shape as to positively come into engagement with the companion loop engaging elements 21, thus causing an increased strength of engagement with the female member 2.

Figure 7:
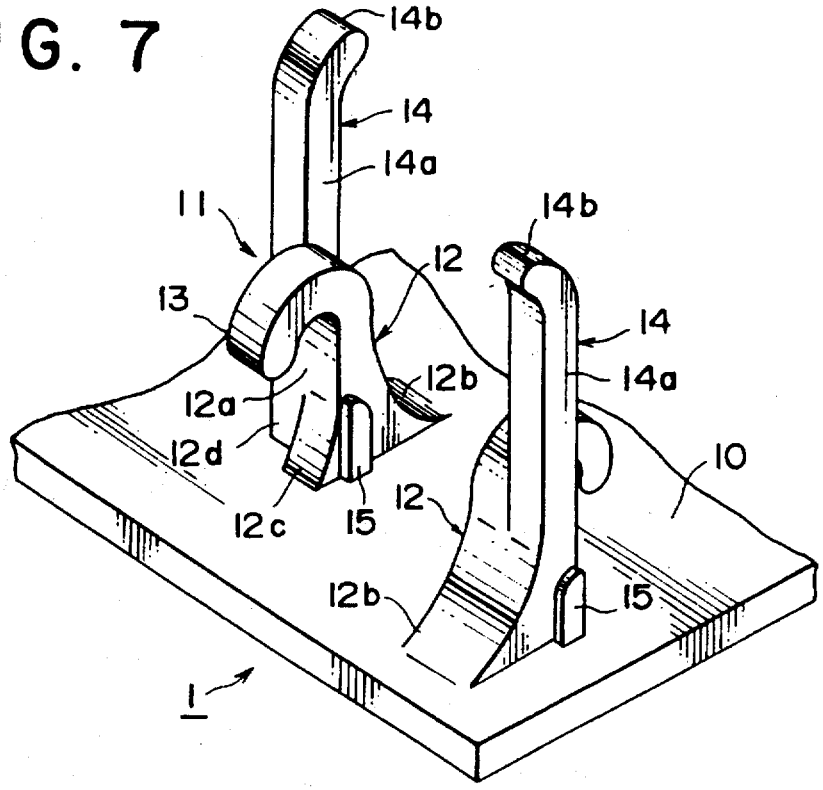
FIG. 7 is a perspective view showing a pattern in which the hook-shape engaging elements of this invention are arranged on a base.
Figure 8:
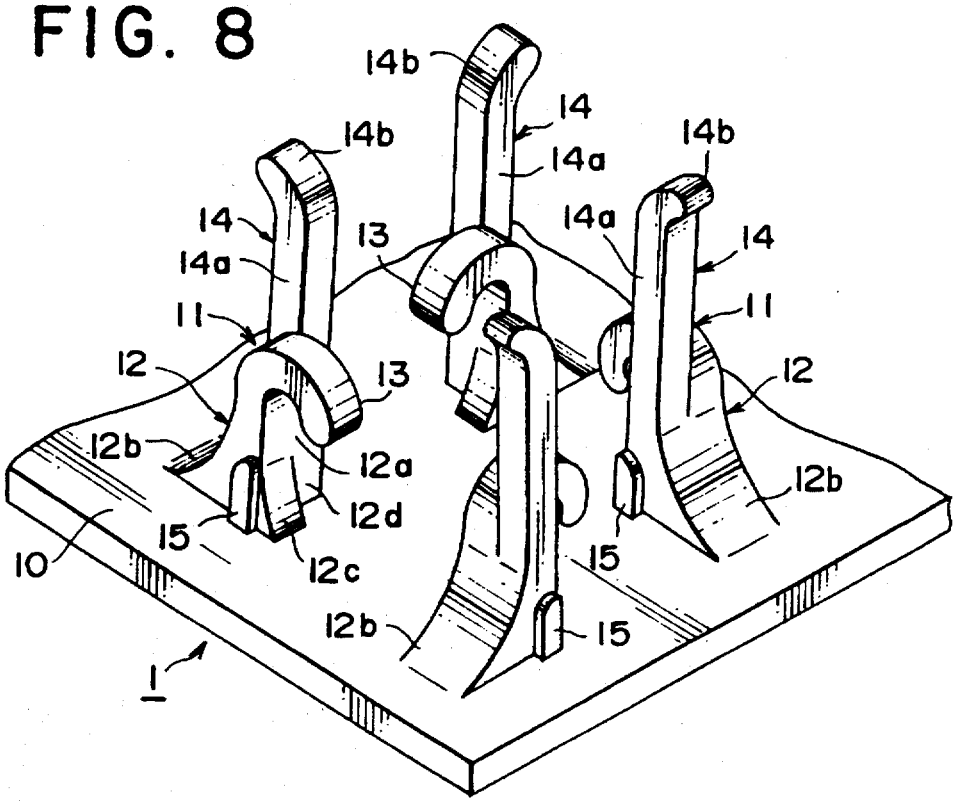
FIG. 8 is a perspective view showing another pattern of the arrangement.
Figure 9:
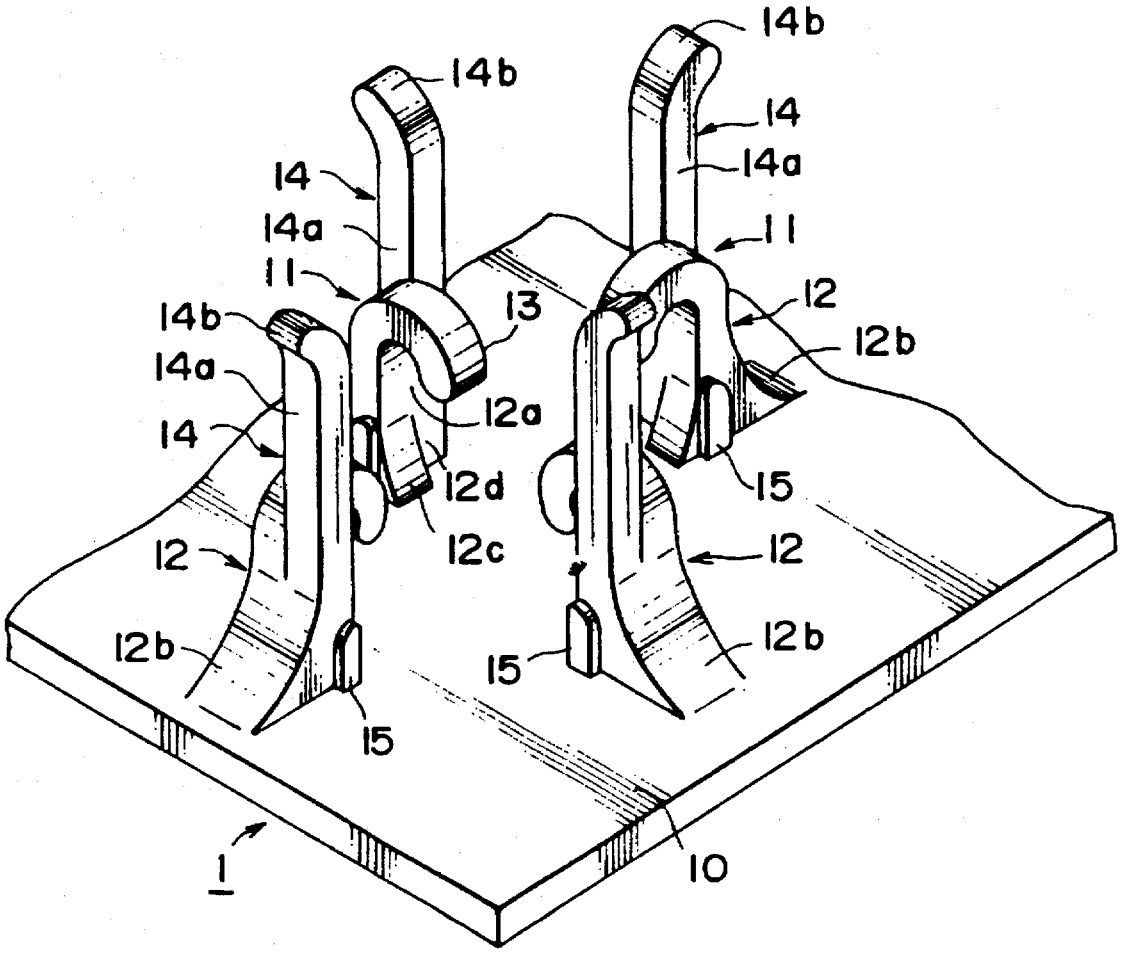
FIG. 9 is a perspective view showing a further another pattern of the arrangement.
Figure 10A:
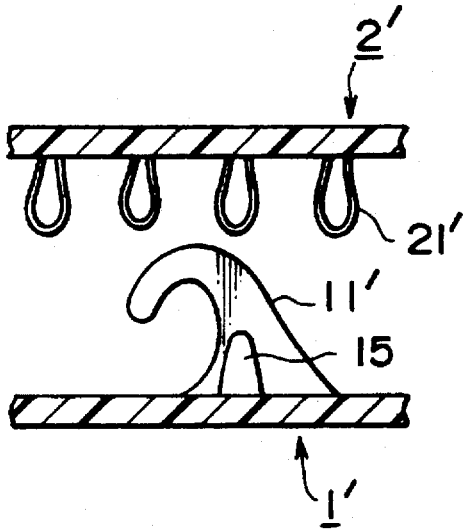
FIG. 10(A) PRIOR ART
FIGS. 10(A) through 10(D) show the manner in which the conventional hook-shape engaging elements come into and out of engagement with loop engaging elements of a companion female member.
Figure 10B:
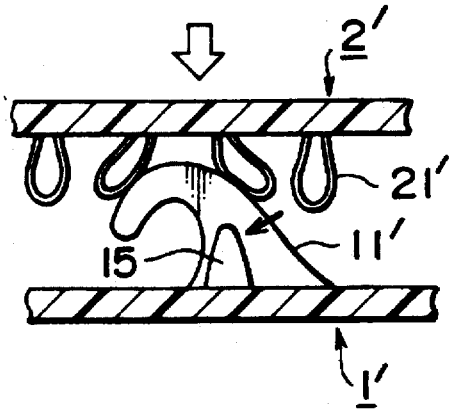
FIG. 10(B) PRIOR ART
Figure 10C:
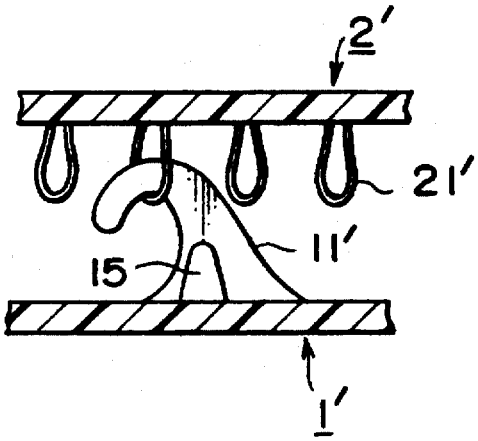
FIG. 10(C) PRIOR ART
Figure 10D:
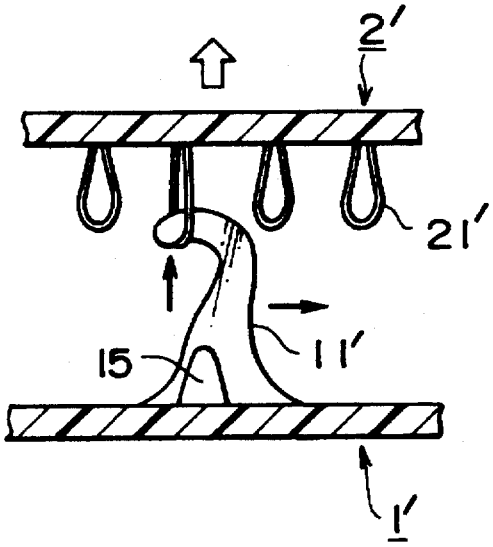
FIG. 10(D) PRIOR ART

In the embodiment of FIG. 1, all of the hook-shape engaging elements 11 arranged on the surface of the base 10 are oriented in a common direction. FIGS. 7 through 9 respectively show various patterns of arrangement in which the hook-shape engaging elements 11 arranged on the surface of the base 10 are oriented in different directions. In the modification of FIG. 7, an adjacent pair of the hook-shape engaging elements 11 are oriented in opposite directions. In the modification of FIG. 8, adjacent four of the hook-shape engaging elements 11 are arranged in such a manner that their hook-shape heads 13 are directed one to the next. In the modification of FIG. 9, adjacent four of the hook-shape engaging elements 11 are arranged in such a manner that the hook-shape heads 13 of confronting hook-shape engaging elements 11 are directed to one another. By changing the orientation of the hook-shape engaging elements 11 in various ways depending on need, it is possible to give the hook-shape engaging elements 11 orientations necessary for adequate engaging strength of the surface fastener.

The structure and arrangement of hook-shape engaging elements should by no means be limited to the illustrated examples and may be selected from many other alternatives.

As mentioned in the foregoing detailed description, in the surface fastener according to this invention, because of its unique structure of the hook-shape engaging element, the branch and the stem flex so as to widen the opening of the hook-shape head when the hook-shape engaging element comes into engagement with the companion loop engaging element, so that the hook-shape head tends to be threaded through the loop engaging element, thus guaranteeing reliable engagement of the male and female members. Further, since the branch prevents the hook-shape head from being deformed due to the loop engaging element when the hook-shape engaging element is removed from the loop engaging element, the loop engaging element would not easily be removed from the branched hook-shape engaging element compared to the case of the sole hook-shape engaging element, thus improving the engaging strength. If the upper end portion of the branch is curved to secure the flexing, and more particularly if the bent end portion has a hook shape, the loop engaging elements other than those in engagement with the hook-shape engaging elements come into engagement with the hook-shape curved end portions so that the hook-shape engaging elements are more difficult to be removed from the loop engaging elements by accident, thereby securing adequate engaging strength.

Further, in the presence of reinforcing ribs on the side surfaces of the stem, it is possible to prevent the hook-shape engaging element from falling sideways, even if the stem is reduced in thickness to a minimum, making the surface fastener adequately durable over repeated use. Since the stem can be reduced in thickness, it is possible to increase the density of hook-shape engaging elements and to secure adequate durability for practical use and necessary engaging strength.

What is claimed is:

1. A molded surface fastener member comprising:

(a) a flat base molded of synthetic resin; and (b) a multiplicity of hook-shaped engaging elements molded on one surface of said flat base, each of said hook-shaped engaging elements having a stem standing substantially perpendicularly from said flat base, a hook-shaped head extending forwardly from one part of a free end portion of said stem, and a branch extending vertically above said hook-shaped head by a predetermined length from another part of the free end portion of said stem and terminating in a backwardly bent portion.

2. A molded surface fastener according to claim 1, wherein said stem has on at least one side base portion thereof a reinforcing rib.

3. A molded surface fastener according to claim 1, wherein said hook-shaped head and said branch are formed by bisecting said stem forwardly and backwardly.

4. A molded surface fastener according to claim 1, wherein said hook-shaped head and said branch are formed by bisecting said end portion of said stem laterally.

5. A molded surface fastener according to claim 1, wherein said hook-shaped head is a double structure having a pair of identical hook-shaped heads situated respectively on opposite sides of said branch, and said two hook-shaped heads and said branch are formed by dividing said end portion of said stem laterally.

6. A molded surface fastener according to claim 1, wherein said bent portion of said branch is in a shape of a backwardly curving hook.

7. A molded surface fastener according to claim 2, wherein said bent portion of said branch is in a shape of a backwardly curving hook.

8. A molded surface fastener according to claim 3, wherein said bent portion of said branch is in a shape of a backwardly curving hook.

9. A molded surface fastener according to claim 4, wherein said bent portion of said branch is in a shape of a backwardly curving hook.

10. A molded surface fastener according to claim 5, wherein said bent portion of said branch is in a shape of a backwardly curving hook.

11. A molded surface fastener according to claim 1, wherein said hook-shaped heads of adjacent said hook-shaped engaging elements are oriented in opposite directions.

12. A molded surface fastener according to claim 1, wherein said hook-shaped heads of adjacent said hook-shaped engaging elements are oriented in perpendicularly intercrossing directions.

13. A molded surface fastener according to claim 1, wherein said hook-shape head and said branch are formed by dividing said end portion of said stem laterally.

* * * * *